United States Patent [19]

Weber

[11] Patent Number: 5,029,351

[45] Date of Patent: Jul. 9, 1991

[54] BABY SUPPORT PILLOW

[76] Inventor: Eugene W. Weber, 334 Avila Rd., San Mateo, Calif. 94402

[21] Appl. No.: 64,581

[22] Filed: Jun. 22, 1987

[51] Int. Cl.[5] ..... A47G 9/00

[52] U.S. Cl. ..... 5/431; D6/596

[58] Field of Search ..... 5/94, 431, 434, 436, 5/424; 128/134; 269/328; 224/158; 108/43; D6/596, 601

[56] References Cited

U.S. PATENT DOCUMENTS

| | | | |
|---|---|---|---|
| D. 259,458 | 6/1981 | Fuller et al. | D6/596 |
| 1,212,515 | 1/1917 | Leavitt | 5/436 |
| 1,432,875 | 10/1922 | Lavagetto | 5/431 |
| 2,522,120 | 9/1950 | Kaskey et al. | 5/436 |
| 2,973,889 | 3/1961 | Phillips | 269/328 |
| 3,555,582 | 1/1971 | Radford . | |
| 3,757,364 | 9/1973 | Downing . | |
| 4,233,700 | 11/1980 | Spann | 5/431 |
| 4,320,543 | 3/1982 | Dixon | 5/434 |
| 4,536,905 | 8/1985 | DeSantis | 5/434 |
| 4,667,356 | 5/1987 | Holmquist | 5/431 |

FOREIGN PATENT DOCUMENTS

| | | | |
|---|---|---|---|
| 641616 | 12/1963 | Belgium | 5/436 |

*Primary Examiner*—Alexander Grosz

[57] ABSTRACT

A baby supporter and positioner that can be used by nursing mothers and any other person who wants to hold and interact with a baby on their lap while seated. The baby support pillow is wedge shaped to provide for a slightly inclined positioning of the baby and to provide for better alignment of the baby's head to the mother's breast. The baby support pillow has a contoured side to allow the pillow to cradle the person's body and provide a firm supportive surface close to the person's body for the baby.

14 Claims, 2 Drawing Sheets

BABY SUPPORT PILLOW

BACKGROUND OF THE INVENTION

This invention relates to support pillows, and specifically to a pillow specially designed to support a baby's head and body while breastfeeding or bottle feeding, and also to be used to support the baby while interacting with it in a variety of other activities.

Heretofore when a mother breast fed her baby she had to cradle the baby in her arms to hold the baby's head at the required height to align with her breast. Holding a baby like this for any length of time puts considerable stress on the mother's body. A common complaint of breastfeeding mothers is lower back pain. A sleeping pillow or furniture pillow could be used to help support the baby's body; however, most pillows of this type have rounded or sloping edges and provide little support where needed. So short of piling many pillows on top of one another it is difficult to get the proper height and support from one easy-to-handle pillow.

Nursing slings have been designed to hold a baby with the weight of the sling pulling on the mother's neck and upper back. This method puts considerable stress on the mother's neck and back. Reversing the baby to nurse on the other breast can be quite cumbersome and annoying to the baby. A sling type device also tends to pull the baby's head and body toward the mother, which restricts the baby's freedom of movement. A sling type device is not suitable for bottle feeding because of this.

Medical and therapeutic pillows are known in various forms, including as shown in U.S. Pat. Nos. 3,555,582, 3,757,364, 4,233,700 and 4,320,543. U.S. Pat. Nos. 3,555,582 and 4,233,700 both show support cushions with wedge-shaped components, but neither has the features or the advantages of the present invention as described below.

SUMMARY OF THE INVENTION

Accordingly, several objects and advantages of my invention are: to provide a firm support for a breastfeeding or bottle feeding baby without putting undo strain on the mother's body; and to provide an easily adjustable support that can accommodate many sizes of babies and mothers.

In addition, additional objects and advantages of my invention are to provide a one piece easy to handle baby support that can be readily reversed to allow for breastfeeding the baby on either side, and to provide a comfortable support for the baby's body to allow the mother and father or any person to more easily hold the baby while interacting with it in such activities as reading, washing, dressing, rocking to sleep and to simplify administering oral preparations such as prescriptions, vitamins, etc.

Further objects and advantages of my invention will become apparent from a consideration of the drawings and ensuing description.

DESCRIPTION OF PREFERRED EMBODIMENT

Figure 1:
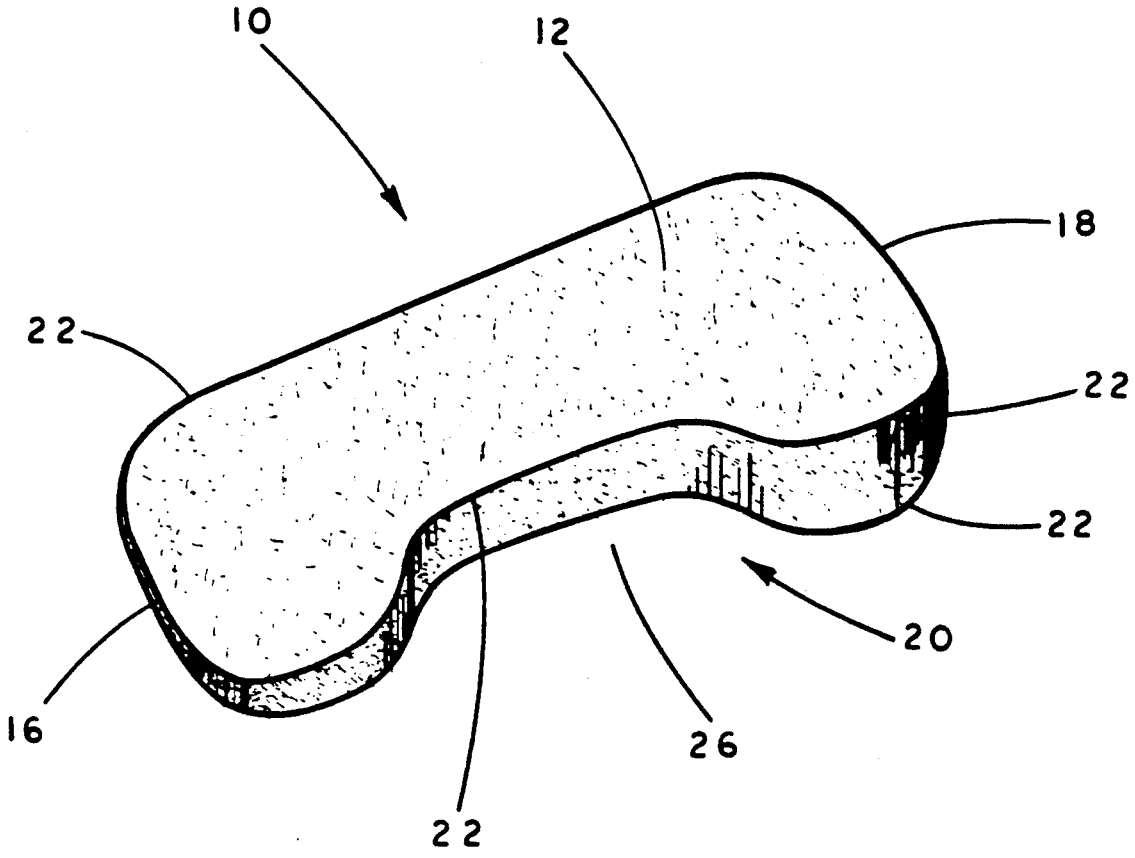
FIG. 1 is a perspective view of my invention showing the contoured side, squared off edges and wedge shaping of the pillow.
Figure 3:
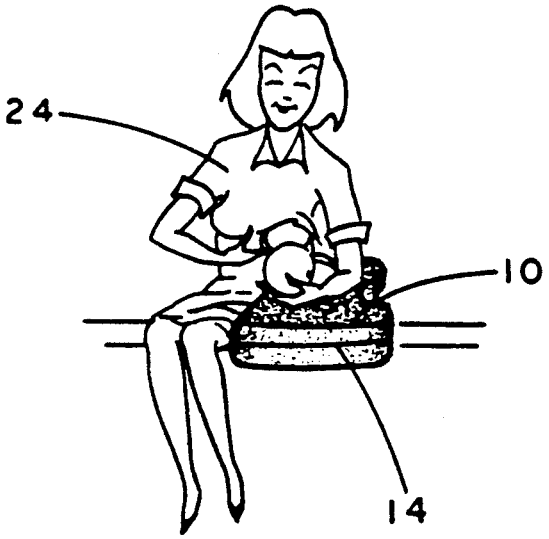
FIG. 3 is a perspective view of my invention showing the baby support pillow positioned along side the mother.

FIG. 1 shows a baby support pillow 10 in accordance with the invention, with its particular shaping characteristics. The pillow is made of a resilient material (e.g. polyurethane foam, foam rubber, etc.), although it could be made of other support materials, even a sealed bag filled with air. There is an outer slip cover 12 that provides a soft comfortable contact surface for the baby's body. This cover material is cleanable, also the entire cover can be removed for washing. This can be accomplished with a zipper, snaps or an overlapping open seam 14 at one end or side, as shown in FIG. 3.

The approximate length of the baby support pillow 10 is 24 inches and should in any event be between about 20 and 30 inches. The overall width is approximately 12 inches (preferably between about 10 and 15 inches). The thin end 16 of the wedge shaped baby support pillow is approximately 2 inches thick (preferably in the range of 1 to 3 inches) and the thick end 18 is approximately 5 inches thick (preferably in the range of 4 inches to 9 inches). A contoured side 20 is shaped to fit around the mother's belly.

As shown in all of the drawings, the baby support pillow 10 has substantially squared corners or edges 22, where top and bottom surfaces meet side and end surfaces. This gives better support for the baby, as further explained below.

Figure 2:
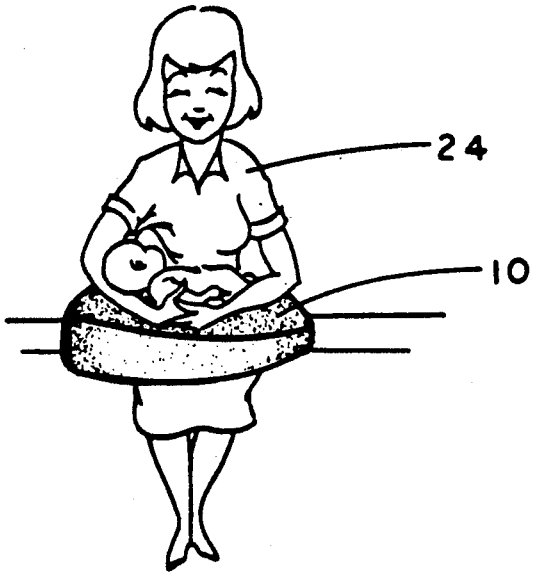
FIG. 2 is a perspective view of my invention as seen by a person viewing a mother with baby in the breastfeeding position.

FIG. 2 shows the baby support pillow 10 as used by a seated nursing mother 24. The contoured side 20 as shown in FIG. 1 allows the pillow to cradle around the mother's body and provide firm support for the baby's head. As contrasted with one or a pile of conventional pillows, the pillow of the invention provides firm support all along its top surface, out to the edges, without tapering or roundness. In the preferred embodiment, the top and bottom surfaces of the baby support pillow 10 are generally planar. However, variations can be made wherein some contouring is provided in these surfaces for receiving a baby. Even if such top/bottom contouring is provided, it is still preferred that the edges or corners, where these surfaces meet side and end surfaces, be relatively squared and abrupt for baby support out to the edges.

A contoured cut out 26 of the contoured side 20 is large enough to allow for some longitudinal (side to side with respect to the mother as in FIG. 2) movement of the pillow. The cut out may be about 3 inches in depth and in the range of about 9 inches to 18 inches in length, preferably about 11 or 12 inches. By moving the baby support pillow 10 in the longitudinal direction the wedge feature allows for a height adjustment of the baby's head to better align with the mother's breast. The wedge feature is also important in that it elevates the baby's head while eating. This can help to reduce the incidence of ear infections caused by feeding a baby while in the horizontal position.

By simply lifting the baby and flipping the baby support pillow over, the baby can be easily repositioned to nurse on the other breast.

The baby support pillow can also be set beside the mother to allow for breastfeeding the baby in what is commonly called the "football hold" position. This position is especially useful for a mother with sensitive nipples; this often occurs when she starts nursing her newborn baby. In this position the contoured cut out 26 can be oriented outwardly, as shown in FIG. 3.

Figure 4:
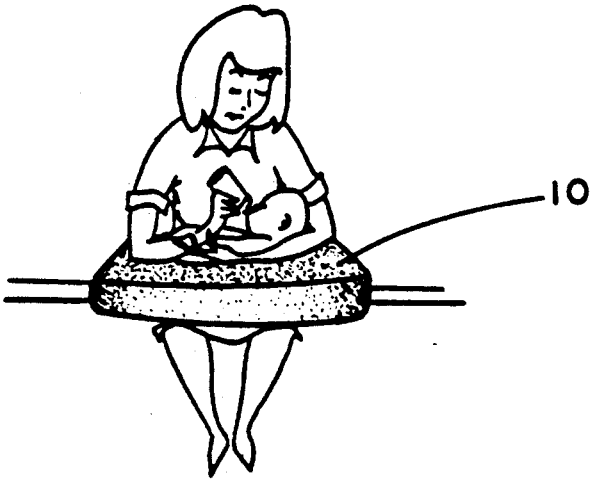
FIG. 4 is a perspective view of my invention showing the baby support pillow positioned for bottle feeding or for parent interaction with the baby.

FIG. 4 shows the baby support pillow 10 with the baby reclining on its back. This positioning of the baby support pillow can be useful for bottle feeding, talking to, washing, dressing and many other interactive functions that people want to do with a baby.

Thus it can be seen that the baby support pillow provides a supportive, easy to use baby positioner that can be easily used for many purposes and by persons of almost any age. The device can be used for bottle feeding as well as breast feeding, and it can be used for changing the baby or otherwise interacting with the baby. Used regularly in the breastfeeding mode it can greatly reduce the stress and fatigue on the mother's body.

While my above description contains many specifications these should not be construed as limitations on the scope of the invention, but rather as an exemplification of one preferred embodiment thereof. Many other variations are possible. For example the dimensions suggested above can be varied to provide for say a small, medium and large size of this invention. Furthermore the materials suggested for the covering and filling could be varied greatly. The baby support pillow could even be molded as one piece using self-skinning foam. Accordingly, the scope of the invention should be determined not by the embodiments illustrated, but by the appended claims and their legal equivalents.

I claim:

1. A baby support device to be used by a seated person, comprising:

a elongated body of sufficient size to support a baby when put between the baby and the seated person's legs, said elongated body having a length substantially greater than its lateral width for supporting the baby's body length, said elongated body having top and bottom surface similarly shaped but non-parallel such that the elongated body is wedge shaped in a gentle slope in the longitudinal direction, so that the baby's head is elevated when the baby lies on the support device, and said elongated body having elongated sides, generally perpendicular to the top and bottom surfaces, one of the elongated sides having a contoured cut out positioned and sized to permit the device to partially wrap around and nest against the seated person's body.

2. A baby support device to be used by a seated person, comprising:

a elongated body of resilient deformable material of sufficient size to support a baby when put between the baby and the seated person's legs, said elongated body having a length substantially greater than its lateral width for supporting the baby's body length, said elongated body having top and bottom surfaces similarly shaped but non-parallel such that the elongated body is wedge shaped in a gentle slope in the longitudinal direction, so that the baby's head is elevated when the baby lies on the support device, and said elongated body having two elongated sides, generally perpendicular to the top and bottom surfaces, one of the elongated sides having a contoured cut out positioned and sized to permit the device to partially wrap around and nest against the seated person's body, whereby the device can be inverted to orient the gentle slope in either direction with respect to the seated person, the top and bottom being similar, whereby the seated person can comfortably nurse the baby on either breast.

3. The baby support device of claim 2, wherein the contoured cut out has curving surfaces for engagement against the seated person.

4. The baby support device of claim 2, including a thick end and a thin end on said wedge shaped elongated body, with the thick end of the wedge of sufficient height to allow for easy alignment of a reclining baby's mouth with the seated mother's breast for nursing.

5. The baby support device of claim 4, wherein the thick end has a thickness of about 4 inches to 9 inches.

6. The baby support device of claim 5, wherein the thick end has a thickness of about 5 inches.

7. The baby support device of claim 4, wherein the thin end has a thickness of about 1 inch to 4 inches.

8. The baby support device of claim 7, wherein the thin end has a thickness of about 2 inches.

9. The baby support device of claim 2, wherein the top and bottom surfaces of the device are generally plainar, with generally squared edges where the top and bottom surfaces meet side and end surfaces, whereby a baby is well supported out to the edges of the surface on which it rests.

10. The baby support device of claim 2, wherein the resilient deformable material comprises a polyfoam material, and including a removable cover over the polyfoam material.

11. The baby support device of claim 2, wherein the length of the elongated body is between about 20 and 30 inches.

12. The baby support device of claim 11, wherein the elongated body has an overall width between about 10 and 16 inches.

13. The baby support device of claim 12, wherein the contoured cut out has a depth of about 3 inches.

14. The baby support device of claim 13, wherein the contoured cut out has a length of about 11 inches.

* * * * *